US005429794A

United States Patent [19]

Kamf et al.

[11] Patent Number: 5,429,794

[45] Date of Patent: Jul. 4, 1995

[54] ALLOYS FOR BRAZING

[75] Inventors: Anders Kamf, Kenosha, Wis.; Leif Tapper, Enköping; Rolf Sundberg, Västerås, both of Sweden

[73] Assignee: Outokumpu Copper Radiator Strip AB, Västerås, Sweden

[21] Appl. No.: 116,404

[22] Filed: Sep. 3, 1993

[30] Foreign Application Priority Data

Sep. 23, 1992 [GB] United Kingdom ..... 9220108

[51] Int. Cl.[6] ..... C22C 9/04

[52] U.S. Cl. ..... 420/477; 420/472; 148/433; 148/434; 228/262.61

[58] Field of Search ..... 420/477, 472; 148/434, 148/433; 228/262.61

[56] References Cited

U.S. PATENT DOCUMENTS 5,167,726 12/1992 LoIacono et al. ..... 148/432

FOREIGN PATENT DOCUMENTS 0197244 11/1983 Japan .
1437056 5/1976 United Kingdom .

*Primary Examiner*—Scott Kastler
*Assistant Examiner*—Sean Vincent
*Attorney, Agent, or Firm*—Smith-Hill and Bedell

[57] ABSTRACT

Alloys for brazing used in heat exchangers, particularly in radiators. The alloys contain 14–31% by weight zinc, 0.1–15% by weight iron, 0.001–0.05% by weight phosphorus and 0–0.09% by weight arsenic, the balance being copper and incidental impurities.

1 Claim, 3 Drawing Sheets

ALLOYS FOR BRAZING

Figure 1:
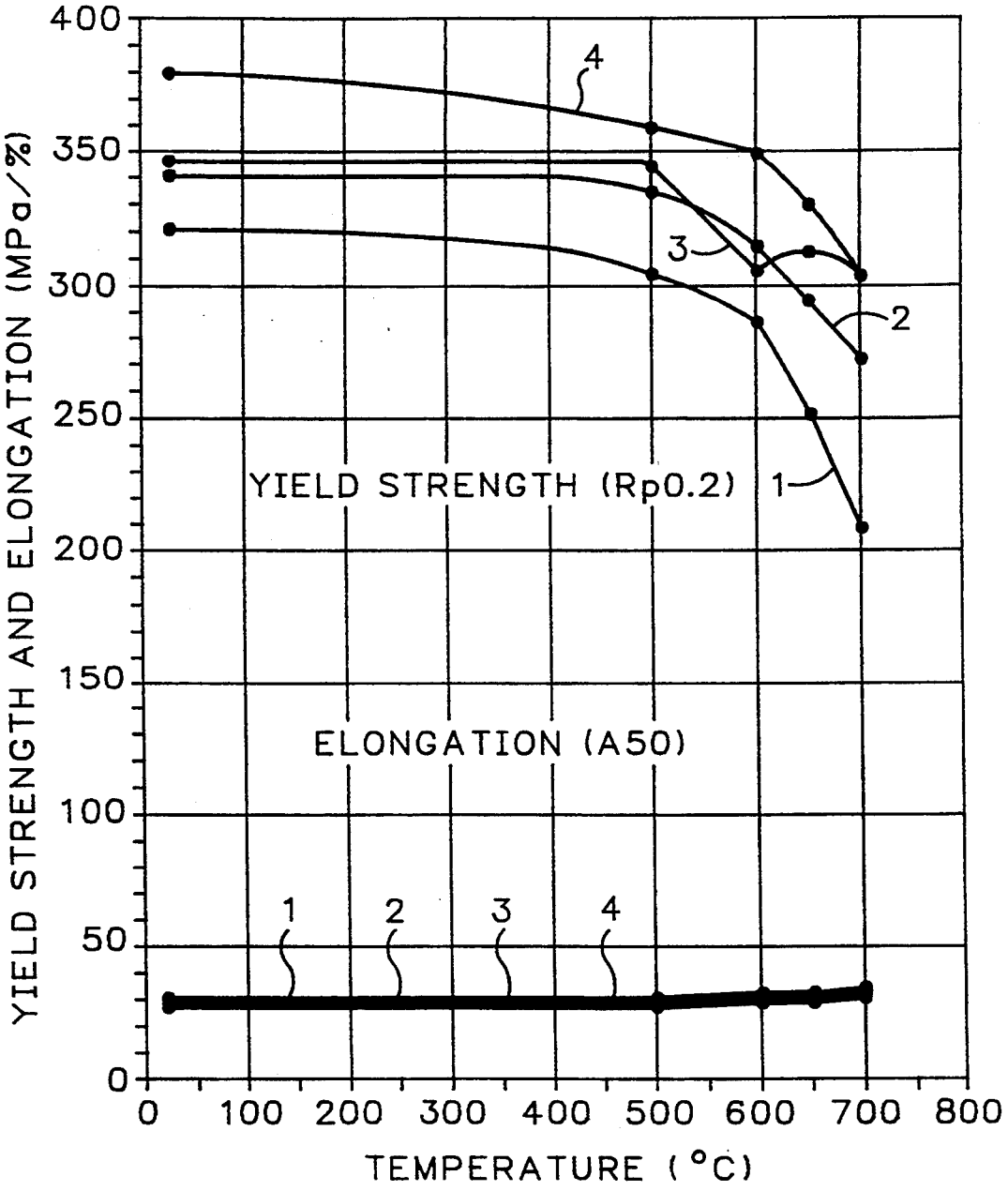

This invention relates to copper-zinc alloys which are easy to braze and which are used in heat exchangers, particularly in radiators.

Heat exchangers, such as radiators, made of copper or brass are conventionally joined through soft soldering. This means that the weakest points in a heat exchanger are the solder joints. In soldering, the metallic parts of a heat exchanger are joined by a molten metal, i.e. a filler metal, the melting temperature whereof is lower than that of the parts to be joined. The molten filler metal wets the surfaces of the parts to be joined without melting them. When the working temperature of the filler metal is over 450° C., the respective term is brazing, and the filler metal is called a brazing filler metal. The working temperature of the brazing filler metal depends on its chemical composition.

The EP patent application 429026 relates to low-nickel copper alloys to be used as brazing filler metals produced by the rapid solidification method. This brazing filler alloy contains at least 0–5 atom percent Ni, 0–15 atom percent Sn and 10–20 atom percent P, the balance being copper and incidental impurities. The alloys of the EP 429026 are based on non-expensive alloy elements that have a low melting temperature and are self-fluxing. The brazing temperature for the alloys is between 600° and 700° C.

The mechanical properties of the material used in a heat exchanger are reached through alloy additions and cold working. In the heat exchangers there are usually fins and tubes which are soldered or brazed together. This means heating to at least the melting temperature of the solder or brazing alloy. A cold worked metal will start to soften, i.e. to recrystallize when heated. Therefore, alloy additions are made to the fin material to increase the softening temperature. Normally brass does not soften during soldering. It is necessary that the fins and tubes of the heat exchangers retain as much as possible of their original hardness after the joining. Otherwise the heat exchangers will be too weak and sensitive to mechanical damage. The brazing temperature is 300° C. higher than the soldering temperature. This means that brass will soften during brazing.

It is known from the publication Kamf A., Carlsson R., Sundberg R., Östlund S., Ryde L., Precipitation of iron in strip cast CuFe2.4—influence on recrystallisation temperature and mechanical properties, published in the congress of Evolution of Advanced Materials, AIM & ASM, Milano 31 May–2 Jun. 1989, that the alloy CuFe2.4 including 2.4% by weight Fe, 0.15% by weight Zn, 0.03% by weight P, rest copper, can get very high softening temperature when the product is a cast material that is cold rolled to the final dimension. With the controlled high cooling rates it is possible to increase the recrystallization temperature of the CuFe2.4 material after cold rolling to obtain an improved combination of electric conductivity and strength. However, the brazing tests, using a braze wetting test in which a small amount of paste or powder made of the brazing filler material of the EP 429026 was placed on the surface of a piece of CuFe2.4, showed that the spreading was not so good and more restricted than on copper.

The object of the present invention is to eliminate some of the drawbacks of the prior art and to achieve a better alloy used in heat exchangers which alloy is easy to braze, so that the alloy retains its hardness and has good corrosion resistance.

According to the invention the alloys contain 14–31% by weight zinc, 0.7–1.5% by weight iron, 0.001–0.05% by weight phosphorus and 0–0.09% by weight arsenic, the balance being copper and incidental impurities. The brazing temperature for the alloys of the invention is between 600° and 700° C. This means that the alloys of the invention can be used for example with the brazing filler material described in the EP patent application 429026.

The alloys in accordance with the invention are advantageously suitable for heat exchangers, particularly for radiators, because they can be brazed without loosing too much strength. They also have good corrosion resistance and good formability in addition to which they can be cast as a strip and welded, if necessary. The good temperature resistance of the alloys of the invention is reached through precipitation or dispersion of the alloy elements, which give a controlled fine grain size.

The alloys of the invention are based on the copper zinc iron (CuZnFe) system. In the copper zinc (CuZn) system, it is possible to control the grain growth and therefore the softening properties also at relatively high temperatures with the iron addition. When using a brazing temperature below 650° C. more than 0.7% by weight iron must be added to achieve the desired temperature stability. When using the brazing temperatures between 650° and 700° C. more than 1% by weight iron must be added for the temperature stability. Phosphorus is added to the alloy of the invention in order to create precipitates with iron. The alloys of the invention will then contain precipitates of iron or precipitates of iron and phosphorus. This means that the grain growth is restricted and the softening during brazing will be lower compared with the alloys without the addition of iron or iron and phophorus. However, for a good corrosion resistance when using more than 1% by weight iron there has to be added arsenic more than 0.04% by weight.

Figure 2B:
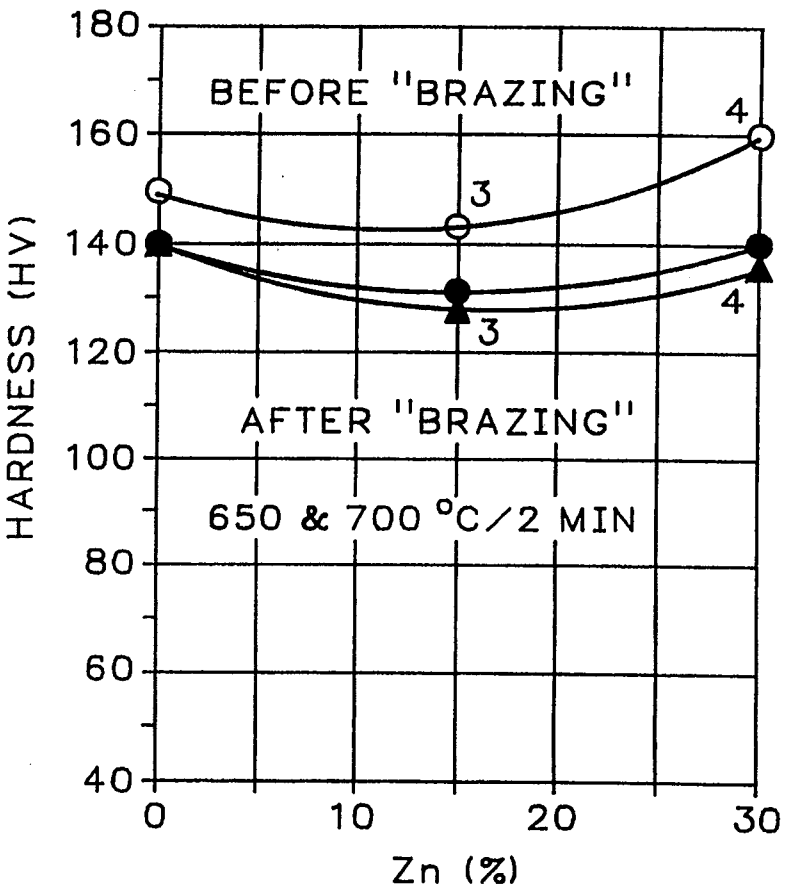
Figure 2A:
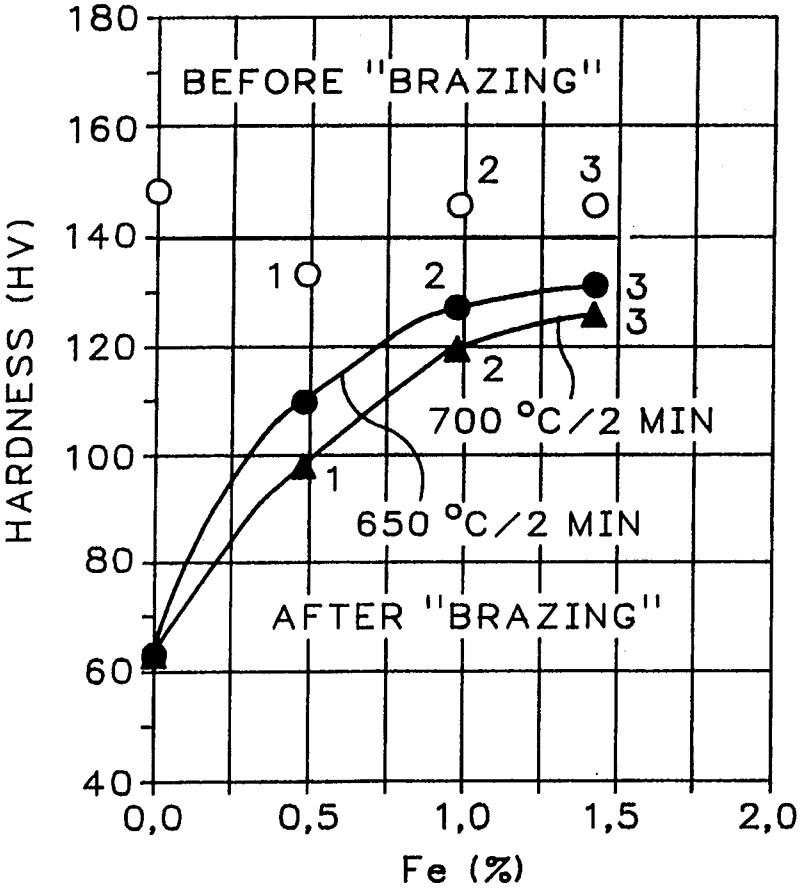

The alloys of the invention are further described in the following example and in the following drawings in which FIG. 1 illustrates as an example the dependence of the yield strength and the elongation of the alloys of the invention on the temperature, FIGS. 2*a* and 2*b* illustrate as an example the effect of iron and zinc of the alloys of the invention to the hardness before and after brazing, FIGS. 3*a*, 3*b*, 3*c* and 3*d* illustrate as an example the effect of zinc, iron and arsenic of the alloys of the invention to the corrosion rating.

EXAMPLE

The alloys in accordance with the invention were first cast and milled. The cast samples were cold rolled to the thickness of 2 mm and then annealed. After pickling and brushing the alloys were further cold rolled to the thickness of 0.5 mm. The compositions of the different alloys in weight percents are given in the following table 1:

| Alloy | Cu | Zn | Fe | P | As |
|---|---|---|---|---|---|
| 1 | 85.3 | 14.2 | 0.49 | 0.006 | |
| 2 | 84.6 | 14.5 | 0.98 | 0.006 | |
| 3 | 84.0 | 14.4 | 1.43 | 0.007 | 0.08 |

-continued

| Alloy | Cu | Zn | Fe | P | As |
|---|---|---|---|---|---|
| 4 | 68.7 | 30.0 | 1.26 | 0.006 | 0.03 |
| 5 | 68.5 | 30.1 | 1.30 | 0.001 | 0.081 |

The softening properties of the alloys of the invention were examined after 2 min annealing in a salt bath at the brazing temperatures of 650° and 700° C. Both hardness, yield strength, tensile strength and elongation were measured. The yield strength and elongation for the alloys of the invention are shown in FIG. 1. The behaviour of the alloys of the invention in FIG. 1 is quite similar to each other, except for the alloy 1, the yield strength whereof is at the brazing temperature range 600°-700° C. much lower than that of the other alloys. However, the temperature stability of the alloys 1-5 is better shown in FIG. 2 which shows hardness before and after 2 min annealing at the temperatures 650° and 700° C. FIG. 2*a* shows the effect of the iron additions in the alloys 1-3 on the hardness and FIG. 2*b* shows the effect of the zinc additions in the alloys 3-4 for the hardness. When the hardness (HV) of 120 is the lowest value for the desired temperature stability from FIG. 2*a* we can see that at least 1% by weight iron is necessary for a good softening resistance during brazing at the temperatures between 650° and 700° C. However, the alloys 1-2 having less than 1% by weight iron are suitable for brazing temperatures lower than 650° C. FIG. 2*b* further shows that the zinc addition does not affect the temperature stability, because after brazing the hardness (HV) is still over 120 for both the alloys 3 and 4.

The corrosion properties of the alloys 1-5 of the invention were tested so that the resistance to intercrystalline corrosion, stress corrosion cracking and dezincification were examined in a test solution containing NaCl, $NaHSO_3$, CuCl and $CuCl_2 2H_2O$. The pH value of the solution was adjusted to 3.0 with HCl. The samples of the alloys 1-5 were fully immersed in the solution for 72 hours at room temperature. The samples were bent strips exposed both with and without a fixed constriction, for testing their susceptibility to cracking. The results as seen in table 2 show both the type of corrosion (a and b after the alloy number mean parallell samples), corrosion depth and the amount of attacks, but also a classification or a rating of the susceptibility to these types of corrosion. The rating between 1 and 3 has been used, where 1 is rather good and 3 bad. The ratings for the different corrosion types have then been put together as a total rating. The total rating was calculated according to the following formula:

Total rating = stress corr. + intercryst. corr. + 3 × dezinc.

Figure 3B:
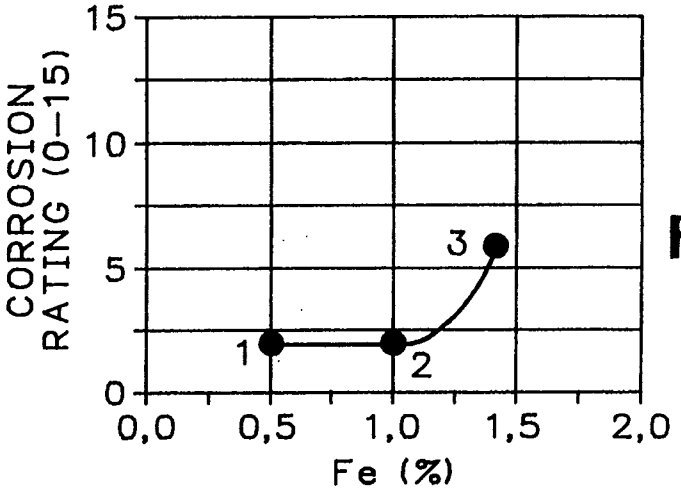
Figure 3D:
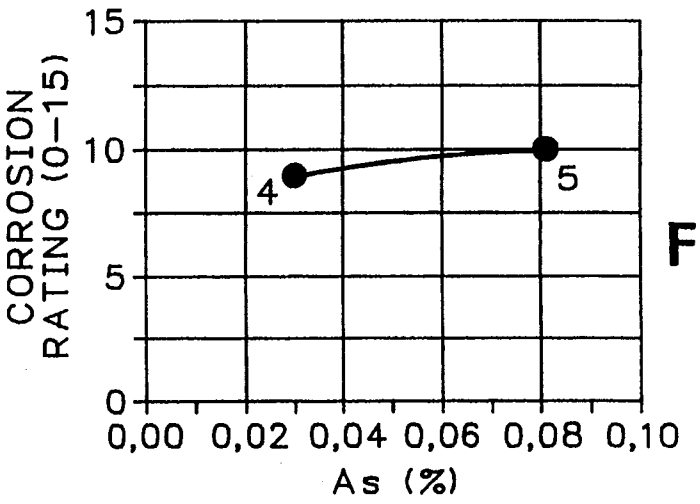
Figure 3A:
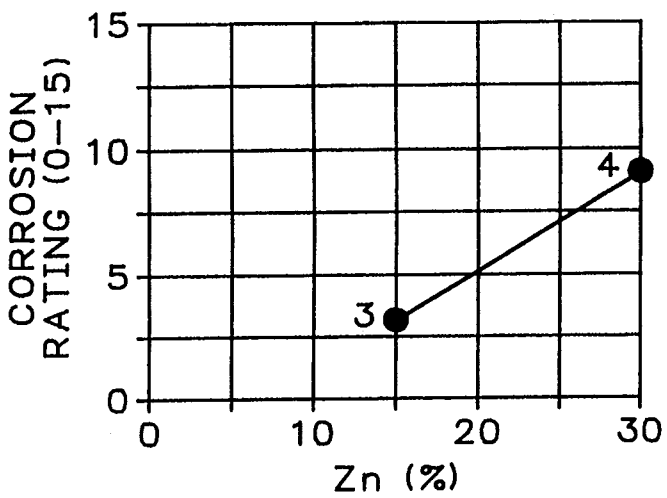
Figure 3C:
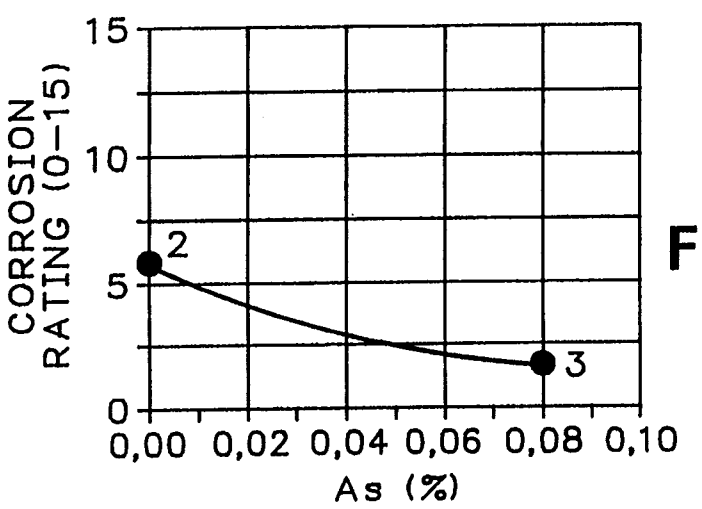

FIGS. 3*a*, 3*b*, 3*c* and 3*d* illustrate the effect of the different additional elements in the alloys of the invention. FIG. 3*a* shows that the corrosion resistance improves by decreasing the zinc content. FIGS. 3*b* and 3*c* show that the iron contents above 1% by weight decrease the corrosion resistance, and it becomes necessary to add arsenic. The arsenic content should be at least 0.04% by weight to achieve the desired corrosion resistance for the alloys 1-3. From FIG. 3*d* we can see that for the alloys 4-5, the corrosion resistance is not improved by the arsenic addition.

Wetting at the brazing temperatures of the alloys 1-3 of the invention was also tested. The tests were carried out so that on a flat piece made of the alloy to be tested, a bent piece made of the same alloy was placed in a leaning position, so that one side of the bent piece formed at least a dotted and curved connection line with the flat piece. The brazing filler material, as described in the EP patent application 429026 was spread onto one end of the connection line of these two alloy pieces. Then the sample pieces were heated to the brazing temperature. The results of the wetting lengths which were measured as the total length of the brazing filler material along the joint between the two pieces, are listed in table 3:

| | Wetting length Brazing temperature | | |
|---|---|---|---|
| Alloy | 620° C. | 650° C. | 680° C. |
| 1 | 16 mm | >60 mm | >60 mm |
| 2 | 15 mm | >60 mm | >60 mm |
| 3 | 16 mm | 24 mm | >60 mm |
| M | 13 mm | 16 mm | 26 mm |

The wetting length for the alloys 1-3 was quite similar and the wetting length for the alloys 1-3 was very much better than for the alloy M (=CuFe2.4) described in the prior art of this invention.

TABLE 2

| | Type of corrosion | | | | | | | | | |
|---|---|---|---|---|---|---|---|---|---|---|
| | Stress corrosion | | | Intercrystalline corrosion | | | Dezincification | | | Total |
| Alloy | Max (μm) | Am.*) (1-3) | Rating (1-3) | Max (μm) | Am.*) (1-3) | Rating (1-3) | Max (μm) | Am.*) (1-3) | Rating (1-3) | rating (0-15) |
| CuFe2,4 | — | — | — | 6 | 3 | 1 | — | — | — | 1 |
| 1a | — | — | — | 24 | 2 | 2 | — | — | — | 2 |
| 1b | — | — | — | 28 | 2 | 2 | — | — | — | 2 |
| 2a | — | — | — | 32 | 2 | 2 | — | — | — | 2 |
| 2b | — | — | — | 20 | 2.5 | 1 | — | — | — | 1 |
| 3a | — | — | — | 24 | 1.5 | 1.5 | — | — | — | 1.5 |
| 3b | — | — | — | 24 | 1.5 | 1.5 | — | — | — | 1.5 |
| 4a | — | — | — | — | — | — | 400 | 3 | 3 | 9 |
| 4b | — | — | — | — | — | — | 240 | 1 | 3 | 9 |
| 5a | — | — | — | — | — | — | 370 | 2.5 | 3 | 9 |
| 5b | — | — | — | 40 | 2 | 2 | 150 | 2.5 | 3 | 11 |

*)Am. = amount of attacks.

We claim:

1. An alloy for brazing used as a base metal in a heat exchanger, particularly in a radiator, consisting essentially of 14-31% by weight zinc, 0.7-1.5% by weight iron, 0.001-0.007% by weight phosphorus, and 0-0.09% by weight arsenic, the balance being copper and incidental impurities.

* * * * *